US005326238A

United States Patent [19]

Schukey

[11] Patent Number: 5,326,238

[45] Date of Patent: Jul. 5, 1994

[54] ROTATING PISTON MACHINE HAVING CAM CONTROLLED ALTERNATING PISTONS

[75] Inventor: Jurgen Schukey, Hamburg, Fed. Rep. of Germany

[73] Assignee: SITA Maschinenbau-und Forschungs GmbH, Hamburg, Fed. Rep. of Germany

[21] Appl. No.: 74,829

[22] PCT Filed: Dec. 4, 1991

[86] PCT No.: PCT/EP91/02317

§ 371 Date: Aug. 5, 1993

§ 102(e) Date: Aug. 5, 1993

[87] PCT Pub. No.: WO92/10648

PCT Pub. Date: Jun. 25, 1992

[30] Foreign Application Priority Data

Dec. 12, 1990 [DE] Fed. Rep. of Germany ..... 9016807

[51] Int. Cl.[5] ..... F01C 1/067; F01C 1/077

[52] U.S. Cl. ..... 418/36; 418/38

[58] Field of Search ..... 418/36, 38

[56] References Cited

U.S. PATENT DOCUMENTS

| | | | |
|---|---|---|---|
| 1,701,534 | 2/1929 | Knopp | 418/36 |
| 1,920,201 | 8/1933 | Kolko | 123/11 |
| 4,872,818 | 10/1989 | Takami | 418/36 |
| 4,938,668 | 7/1990 | Schukey | 418/38 |

FOREIGN PATENT DOCUMENTS 0316346 5/1989 European Pat. Off. .

*Primary Examiner*—John J. Vrablik

*Attorney, Agent, or Firm*—Hayes & Reinsmith

[57] ABSTRACT

A shaft (5) is driven in the rotary piston machine. The torque is transmitted via first cam rings (7), connected to it, to rolling bodies (9) supported in cages and from these rolling bodies to second cam rings (8), which drive the rotation bodies (3) of the rotary piston machine. The cam rings (7, 8) and the rolling bodies (9) are, in this case, partially provided with bevel-wheel teeth and partially with cam track teeth (FIG. 3 ). The rotary piston machine can also be used as an engine and is characterised by a particularly high efficiency.

20 Claims, 13 Drawing Sheets

ROTATING PISTON MACHINE HAVING CAM CONTROLLED ALTERNATING PISTONS

The invention relates to a rotary piston machine having a casing, having a shaft supported in the casing, having an annular space in which two rotation bodies are arranged and on whose walls, in which inlet and outlet openings are provided for the working medium, the rotation bodies are in sealing contact, each rotation body having sector-shaped paddles extending radially outwards, the two rotation bodies being coaxially arranged and their paddles interleaving with one another in such a way that each paddle of one rotation body is arranged between two paddles of the other rotation body, a cam track control being provided by means of which, on rotation of the shaft, the two rotation bodies execute revolutions with cyclic changes to the rotational velocity and the distances between the paddles of the two rotation bodies, and the cam track control has first cam track control means in the form of first cam rings, second cam track control means in the form of second cam rings and third cam track control means in the form of a cage with, held within it so that they cannot be displaced in the peripheral direction, rolling bodies narrowing conically to both ends, which rolling bodies roll on the first and second cam rings, one of the cam track control means being connected to the shaft and another of the cam track control means being torsionally connected to one of the rotation bodies and the remaining cam track control means being connected to the casing.

In such a rotary piston machine (EP-B1-0 316 346), the cam track control of the rotation bodies takes place in each case by means of two sets of elements which each have an inner cam ring, rolling bodies and an outer cam ring. Two such sets of controls are necessary because the rolling bodies can only be pressed outwards by the inner cam ring over a certain angular range (e.g. 45°) and these rolling bodies then in turn rotate the outer cam ring by the outwardly directed force in such a way that a torque can be transmitted from the inner cam ring to the outer cam ring. Subsequently, the rolling bodies must then be moved inwards again; during this time, no torque can be transmitted from the inner cam ring to the outer cam ring. It is therefore necessary to provide a second set of such a cam track control, which effects the torque transmission in this angular range. The same applies correspondingly, of course, when torques have to be transmitted from the outer cam ring to the inner cam ring. It is obvious that the construction is relatively complicated due to the large number of elements of the cam track control and that increased friction losses can also occur. In addition, the cam rings have a relatively complicated shape so that their manufacture is complicated and expensive.

The object of the invention consists in the creation of a rotary piston machine, of the type mentioned at the beginning, which is more simply constructed.

The solution according to the invention consists in the fact that the rolling bodies are provided with bevel-wheel teeth, in the fact that the surfaces, directed towards the rolling bodies, of the cam tracks of the cam rings are arranged in a rotationally symmetrical area corresponding to the surface of the rolling bodies and are provided with corresponding internal bevel-wheel teeth, and in the fact that, as a maximum, one cam track control with a first and a second cam ring and rolling bodies is provided for each rotation body.

Instead of two of the sets of elements mentioned, only one set remains necessary. The rolling bodies no longer transmit the torque from the first to the second cam ring, or vice versa, by moving outwards or inwards. Rather, they retain their radial position, at least in the main, and transmit the torques by rotation with the aid of the teeth.

In this case, the rolling bodies roll on the relatively narrow cam tracks which protrude from the surfaces of the cam rings directed towards the rolling bodies. These surfaces are located in areas which have substantially the same double-conical shape as the rotation bodies and are likewise provided with teeth. Such substantially conical surfaces can be manufactured far more easily than the complicated cam shapes of the previously known rotary piston machine. The surfaces of the cam rings directed towards the rolling bodies can also, overall, be rotationally symmetrical or double-conical in shape, with the exception of the protruding cam tracks, so that they are likewise easier to manufacture.

Although it is conceivable to provide only one rotation body with a cam track control, it is expedient to provide one such cam track control for each of the rotation bodies.

So that the cam track control can operate without clearance, it is expedient to provide for the teeth to be involute teeth whose involute geometry is at right angles to the axis of the rolling body.

The advantages of involute teeth are known to the specialist. If the involute geometry is at right angles to the axis of the rolling body, and not, as is otherwise usual in the case of bevel-wheel teeth, at right angles to the surface of the cone, there is a profile displacement near the centre line of the cam track in which the gear-wheels still engage with one another without clearance. This therefore provides in each case, so to speak, a null transmission on the centre line and V-null transmissions on both sides (Decker, "Maschinenelemente, Gestaltung und Berechnung", Carl Hanser Verlag Munich 1963, pp. 370–373).

In involute gears, the engagement angle according to DIN 867 is 20°. If provision is made for the engagement angle to be approximately 30° to 50° in particular approximately 35° to 40° it is then possible for the cam rings and rolling bodies to transmit the desired torques and also to accept radial forces. The cam track controls can therefore act as additional bearings. Under certain circumstances, it will even be possible to dispense completely with other bearings, which further simplifies the construction of the rotary piston machine.

If the cam rings are built up from two halves arranged axially in sequence, they are easier to manufacture. In addition, the cam track control can be more easily assembled. If the cam rings are clamped together axially, which can take place by means of clamping and/or with corresponding springs, radial forces could act on the bearings of the rolling bodies if, for example, the inner cam rings exert a larger radial force than the outer cam rings. It is therefore expedient to make provision to ensure that the rolling bodies, which cannot move in the peripheral direction, are held in bearing arrangements which can be displaced in the radial direction at least by a certain amount. In this case, the rolling bodies can escape from the uneven forces.

It is expedient, in this case, for the rolling body journals in the bearing arrangements to be subjected to an elastic force in the direction towards the axis of rotation. If no torques are acting, the journals take up the position adjacent to the axis of rotation without clearance. If the torque increases, the journals in the bearing arrangements can give way towards the outside as far as a new limiting position. In this way, the flank clearance necessary is achieved with a precisely defined maximum clearance.

In most cases, the intention will be that the rotation bodies should not execute any net rotational motion relative to one another. For this purpose, it is expedient to provide for the number of teeth of the inner and outer cam rings to be the same and for this number to be divisible by the number of paddles. During operation, the central region of the rolling body will then interact with the outer cam ring and its end regions will interact with the inner ring.

It is advantageous for each cam track control to have the same number of rolling bodies as the number of paddles per rotation body.

It is immediately possible to connect the outer cam rings to the corresponding rotation bodies in such a way that the connection is completely present in the part near the axis. The seal surrounding the corresponding connecting part can therefore likewise be made relatively small and does not wear much because relatively small relative velocities between the rotation and the rotating parts occur here.

The invention is not limited to the cases in which inner and outer cam rings are present, as is the case in the prior art (EP-B1-0 316 346). It is possible to provide, advantageously but not necessarily, for the cam rings to be torsionally connected to the shaft and the second cam rings to be torsionally connected to a rotation body and for the cage to be connected to the casing. Although, as is the case in the prior art, the first cam rings can be arranged radially inwardly of the rolling bodies and the second cam rings can enclose the first cam rings and the rolling bodies. It is also possible to provide, in accordance with the invention, for the second cam rings to be arranged radially inwardly of the rolling bodies and the first cam rings to enclose the second cam rings and the rolling bodies. Because the engagement of the first cam rings with the rolling bodies extends over a larger angular range in this case, the possibly substantial torque can be better transmitted from the shaft to the rolling bodies in this way. In addition, the second cam rings have a smaller mass and a smaller moment of inertia so that the mass which has to be repeatedly accelerated and retarded is reduced.

In a further advantageous embodiment, it is possible to provide for the first and second cam rings to be arranged adjacent to one another radially inside the rolling bodies. In this case also, the forces and torques can be effectively transmitted because of the teeth, which would not be possible in this embodiment without teeth.

In this case, there is no cam ring outside the rolling bodies. The rolling bodies can, however, be enclosed by a third cam ring of large mass which (with the exception of the guidance by the teeth) is freely rotatable and can be retarded or accelerated precisely in each case against the acceleration and retardation motions of the rotation bodies in order, by this means, to ensure smoother running.

If the rolling bodies consist of two parts which can be rotated independently of one another, the torque can, in the latter case, be initially transmitted from the first cam ring to the first part of the rolling body and from there to the third cam ring of large mass. From the latter, the torque is then transmitted further via the second part of the rolling body to the second cam ring and from there to the rotation body. In this case, a larger number of transmission steps are obtained.

In a further embodiment, it is possible to provide for the first and second cam rings to enclose the rolling bodies; both cam rings, which are arranged adjacent to one another, therefore interact with the rolling bodies from the outside.

In another advantageous embodiment, the first cam rings are connected to the casing, the second cam rings are connected to a rotation body and the cage is connected to the shaft. In this case, therefore, the torque is not transmitted from the shaft to the first cam rings but to the cage which carries the rolling bodies.

Because the distance between the teeth increases with increasing diameter in the direction towards the end of the truncated cone, problems can occur at this location. These large distances can be avoided if half of each of the conical surfaces of the rolling bodies and the cam rings has bevel-wheel teeth and the other half has elevated cam tracks. The cam track is, so to speak, interrupted and continues, after a certain angular range on one surface, on the other surface of the other part.

For even running, it is very important that the teeth and cam tracks should be configured in such a way that a maximum angular velocity of one rotation body in each case corresponds to a minimum angular velocity of the other rotation body, that the angular velocity maxima and minima should be arranged, in each case, at distances apart of half the cycle duration, should have the same values in the centre between two extreme values, and that the change with time should be a flattened function in the region of the maxima.

The invention is described below using advantageous embodiments with reference to the enclosed drawings. In these:

Figure 1:
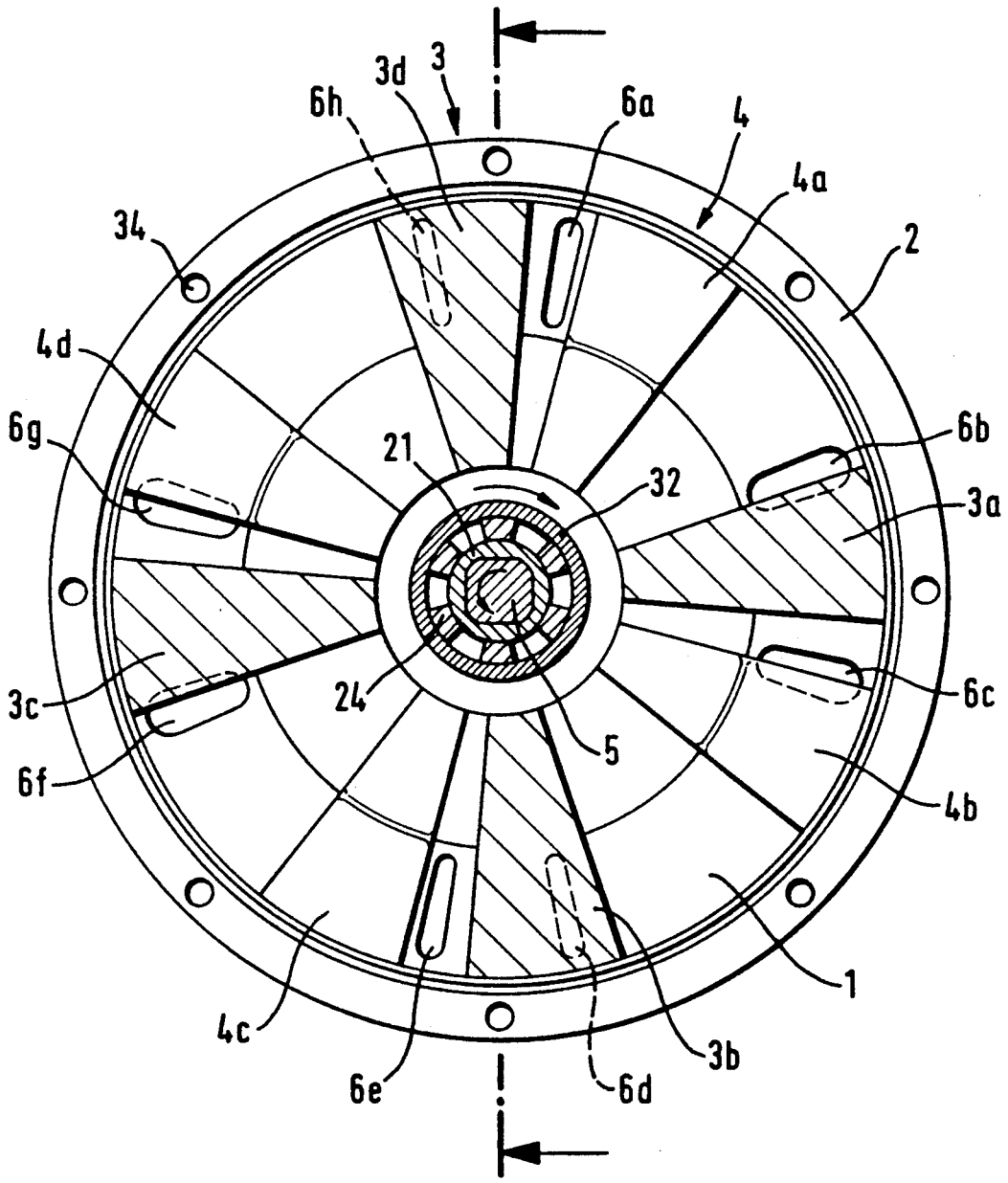
FIG. 1 shows a section through a radial plane of the annular space of a rotary piston machine of the invention, with the two rotation bodies.

The annular space 1 of a rotary piston machine of the invention is shown in FIG. 1 and this annular space 1 is surrounded by parts of the casing 2. The two interleaving rotation bodies, which are configured as the paddle wheels 3 and 4, are located in the annular space 1. The paddle wheel 3 has the paddles 3*a*, 3*b*, 3*c* and 3*d*, while the paddle wheel 4 has the paddles 4*a*, 4*b*, 4*c* and 4*d*. Both paddle wheels are driven by a centrally arranged shaft 5 in a manner still to be described. Various inlet openings and outlet openings in the end wall of the annular space 1 are indicated by 6*a*–*h*.

The mode of operation of this arrangement is as follows. If the shaft 5 moves in the anti-clockwise direction, the paddles wheels 3 and 4 are rotated with different velocities in the clockwise direction in a manner still to be described. In the position shown, for example,. the paddle wheel 4 would rotate in the clockwise direction more rapidly than the paddle wheel 3. In this case, the working space between the paddles 3*d* and 4*a* would increase so that gas is taken in through the inlet port 6*a*. At a later time, this inlet port 6*a* is then closed by the slowly following paddle 3*d*. Approximately from this moment onwards, the paddle 3*d* begins to move more rapidly than the paddle 4*a*, so that the working space between the two paddles is reduced and the gas is compressed until both paddles have moved sufficiently far that the working space is over the outlet opening 6*b*, so that the gas can escape at this point. At this time, the paddle 3*d* can be brought up to the paddle 4*a* so that gas is completely expelled at this point.

This mode of operation can be used both for a compressor and for an internal combustion engine. It would only be necessary to provide combustion spaces, fuel conduits, etc.

Figure 2:
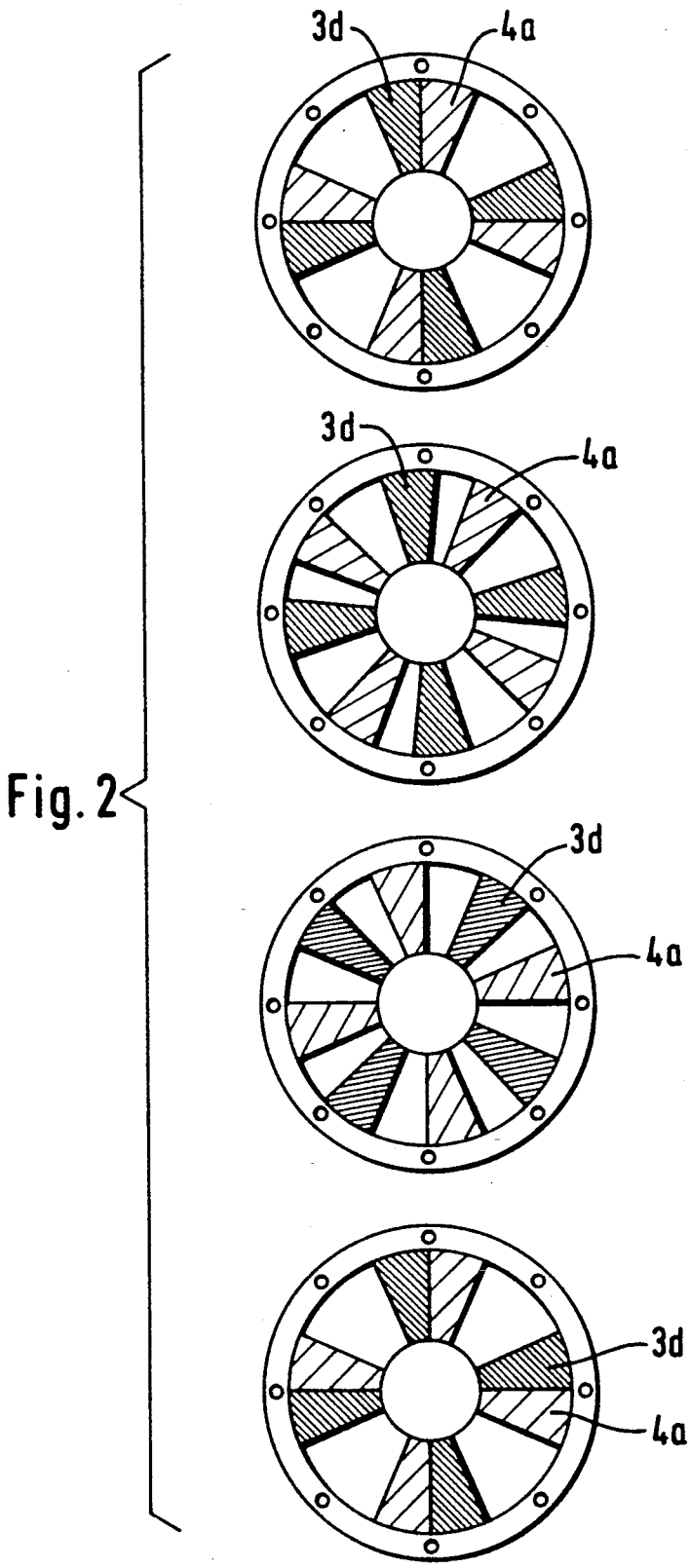
FIG. 2 shows the two rotation bodies in different positions.

Four phases of the working cycle just described are represented in FIG. 2. After a 90° rotation of the two rotation bodies, a new working cycle begins.

Figure 3:
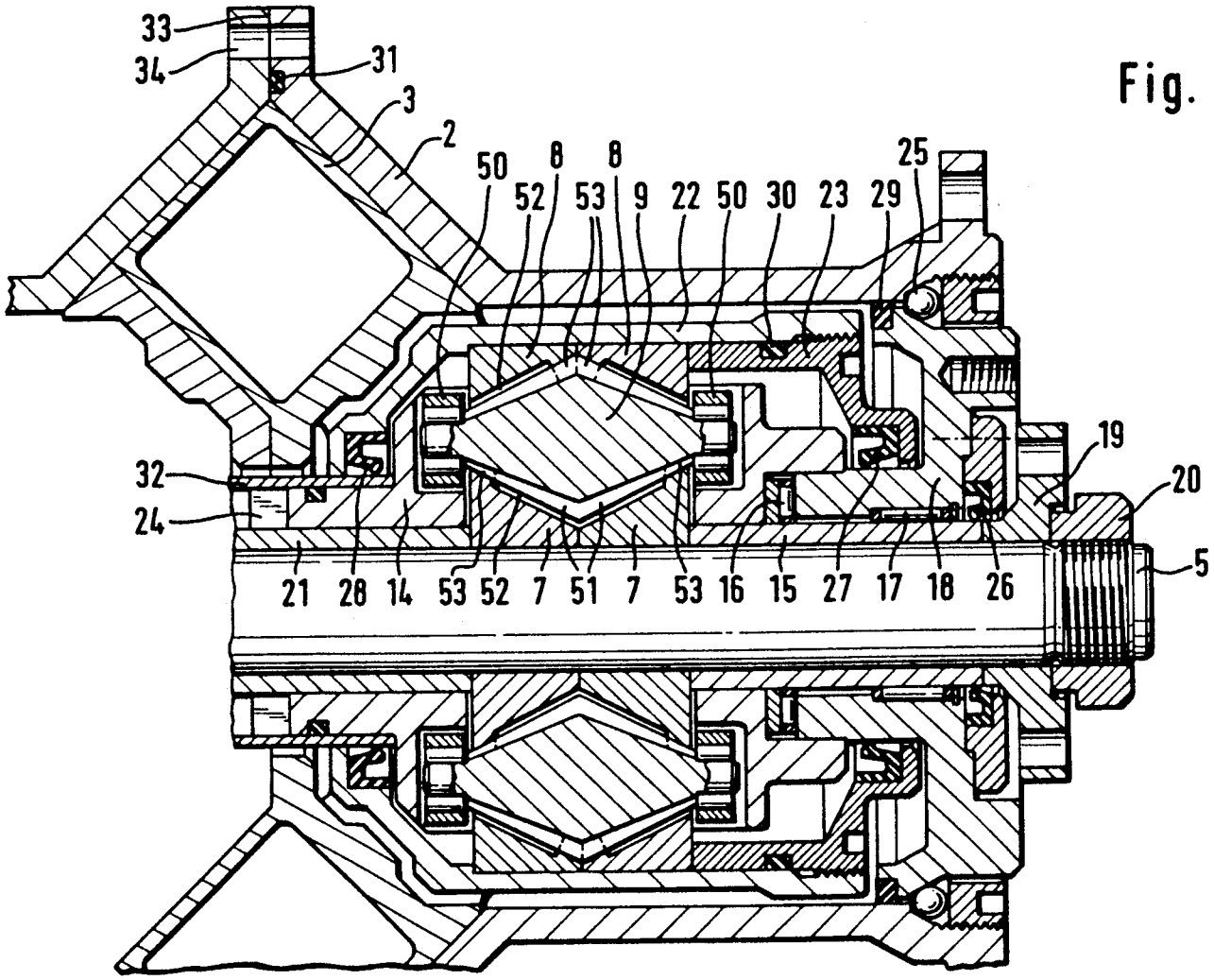
FIG. 3 shows one half of the machine in cross-section.

An axial section of one half of the machine according to the invention is represented in FIG. 3. The other half of the machine continues to the left, essentially as a mirror image.

The drive shaft 5 is rotatably supported in the casing 2 by means of a distance sleeve 15 and journal and thrust bearings 16, 17 and a casing flange 18. Following on outside the distance sleeve 15, there are, in addition, a coupling flange 19 and a nut 20. The inner cam rings 7 consisting of two parts follows inwardly of the distance sleeve 15. This is followed on the left by a distance sleeve 21 which leads to the corresponding inner cam ring 7 on the other end, this other cam ring being intended for the drive of the other of the two rotation bodies.

The two halves of the cam inner rings 7 are pressed together via the distance sleeves 15 and 21 and a corresponding opposing pressure element on the left-hand side of the machine (not shown) by tightening the nut 20 so that the rolling bodies 9 are pressed outwards and, specifically, against the outer cam rings 8. The latter likewise consist of two halves and are arranged torsionally fixed in an outer sleeve 22 which is connected to the rotation body 3. The outer cam rings 8 are not only secured by means of closing flanges 23 but are also pressed together in order to create a pressure opposing the pressure of the rolling bodies 9. The halves of the inner rings 7 or outer rings 8 can also be pressed together by means of spring elements.

Finally, the cage 14, in which the rolling bodies 9 are supported, is fastened to the casing flange 18 and is torsionally connected to the cage on the other end of the arrangement by means of a crown gear 24. In this way, the cage is fixed in the peripheral direction relative to the casing 2. The angular setting of the cage 14 relative to the casing can, however, still be changed by changing the angular setting of the casing flange 18 relative to the casing 2 by means of an adjustment bearing 25.

The rolling bodies 9 are not directly supported in the cage 14 but in bearings 50 of externally cuboid configuration which are accommodated in corresponding grooves of the cage 14 in such a way that they have no clearance in the peripheral direction but can reciprocate a little in the radial direction. This makes it possible to press the rolling bodies 9 outwards on clamping.

In addition, seals are indicated by 26 to 30 and a further seal between the casing halves is indicated by 31. Finally, 32 is a sliding sleeve between the cage 14 and the rotor 3.

As has been stated, the casing 2 is made up of two halves, the seal 31 being provided at the split line 33 of the casing. If the sealing effect between the paddles of the rotation bodies 3, 4 and the wall of the annular space 1 deteriorates, it is possible to ensure, by tightening a bolt led through the hole 34, that the two casing halves are moved closer to one another so that there is a better contact between the casing walls and the rotation bodies 3, 4 in the annular space. The sealing effect is improved by this means.

The rolling bodies 9 configured in the form of a double cone are provided with bevel-wheel teeth 51. These are involute teeth, the plane of the involute being at right angles to the journal of the rolling bodies 9. The cam rings 7 and 8 have, on the inside, an area which is essentially similar to the outer surface of the rolling bodies 9. There are, however, intermediate spaces 52 between the rings 7, 8, on the one hand, and the rolling body 9, on the other. The rings 7, 8 on the one hand, and the rolling body 9, on the other, are only in contact in the region of the cam tracks 53 which are provided as elongated protrusions on the inner surface of the cam rings 7, 8. These protrusions carry involute teeth on their surface which correspond to those of the rolling bodies 9. The teeth of the rolling bodies 9, as well as those of the cam tracks 53 have, like bevel-wheel teeth, a larger module or a larger pitch in the centre than at the axial ends of the rolling body 9. In the peripheral direction, the cam tracks 53 have different distances from the central plane. In consequence, the transmission ratio changes—both from the inner cam ring 7 to the rolling body 9 and from the rolling body 9 to the outer cam ring 8. If the shaft 5 is now driven, the inner ring 7 rotates uniformly with it. The rolling body 9 will take up an alternating rotational velocity depending on how far, at the moment, the cam track 53 is from the centre line at the contact position between the rolling body 9 and the inner ring 7. The transmission ratio between the rolling body 9 and the outer ring also varies correspondingly so that the rotation body 3 executes the desired, non-uniform rotary motion.

The embodiment of FIG. 3 has four rolling bodies 9, of which two are visible in the figure. Two further rolling bodies 9 are located at an angular distance of 90° in front of the plane of the drawing and behind the plane of the drawing. The cam tracks 53 have, in this case, a curve (distance from the central plane as a function of the angle about the central axis of the rolling body) which has a period of 90°.

Figure 4:
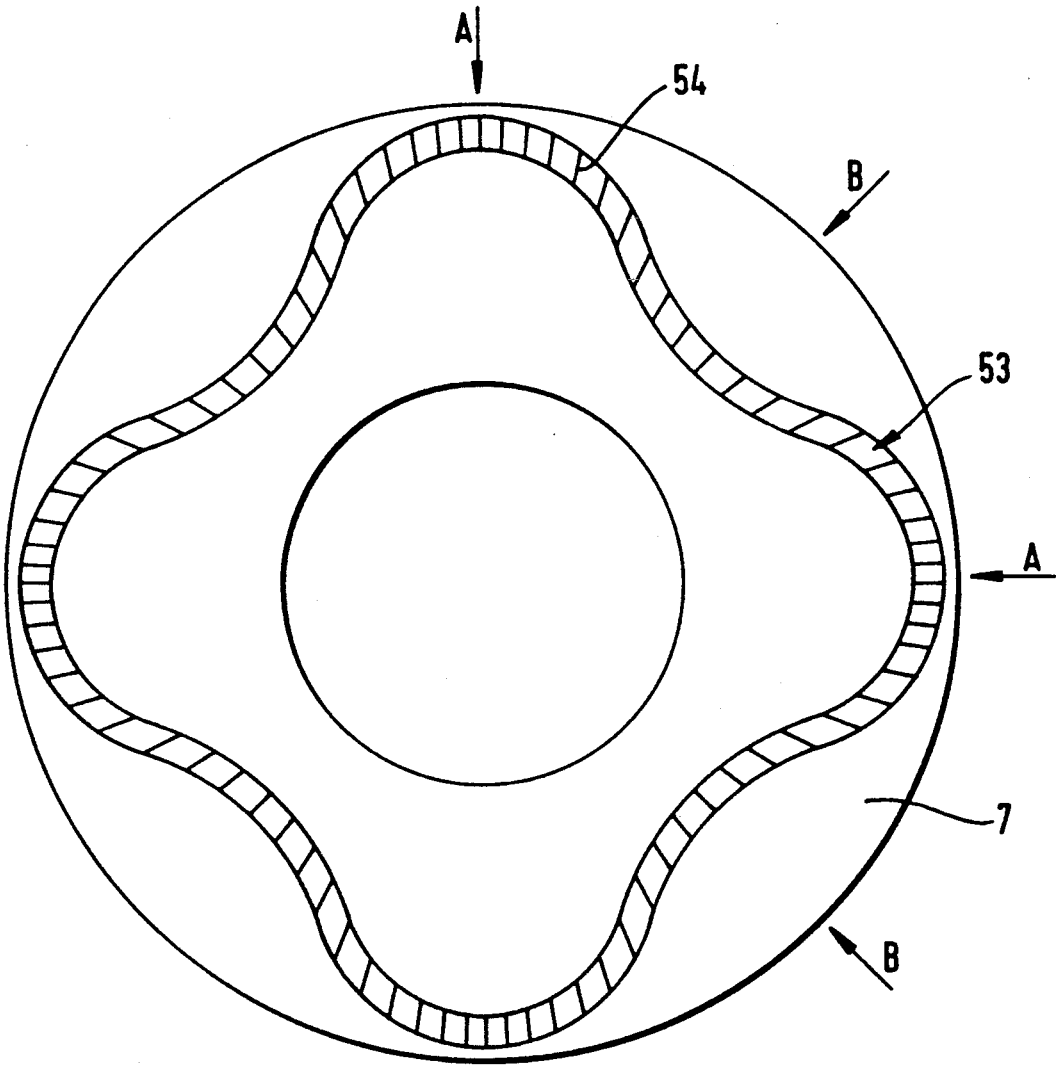
FIG. 4 shows the cam track on the surface of the inner cam ring.

The curve track of the outer surface of a half of an inner cam ring 7 is shown in FIG. 4. The cam track 53 has, as may be clearly seen, a distance from the central plane which varies with angle. The involute teeth 54 have a larger module (pitch, distance between teeth) near the centre line (at B) than they have in the outer region (at A).

Only the surroundings of a rolling body 9 are represented in each of the FIGS. 5 to 11 in order to make clear the mode of operation of other embodiments. In contrast to FIG. 1, the relationships to the left of the central plane of the machine are represented in this case.

Figure 5:
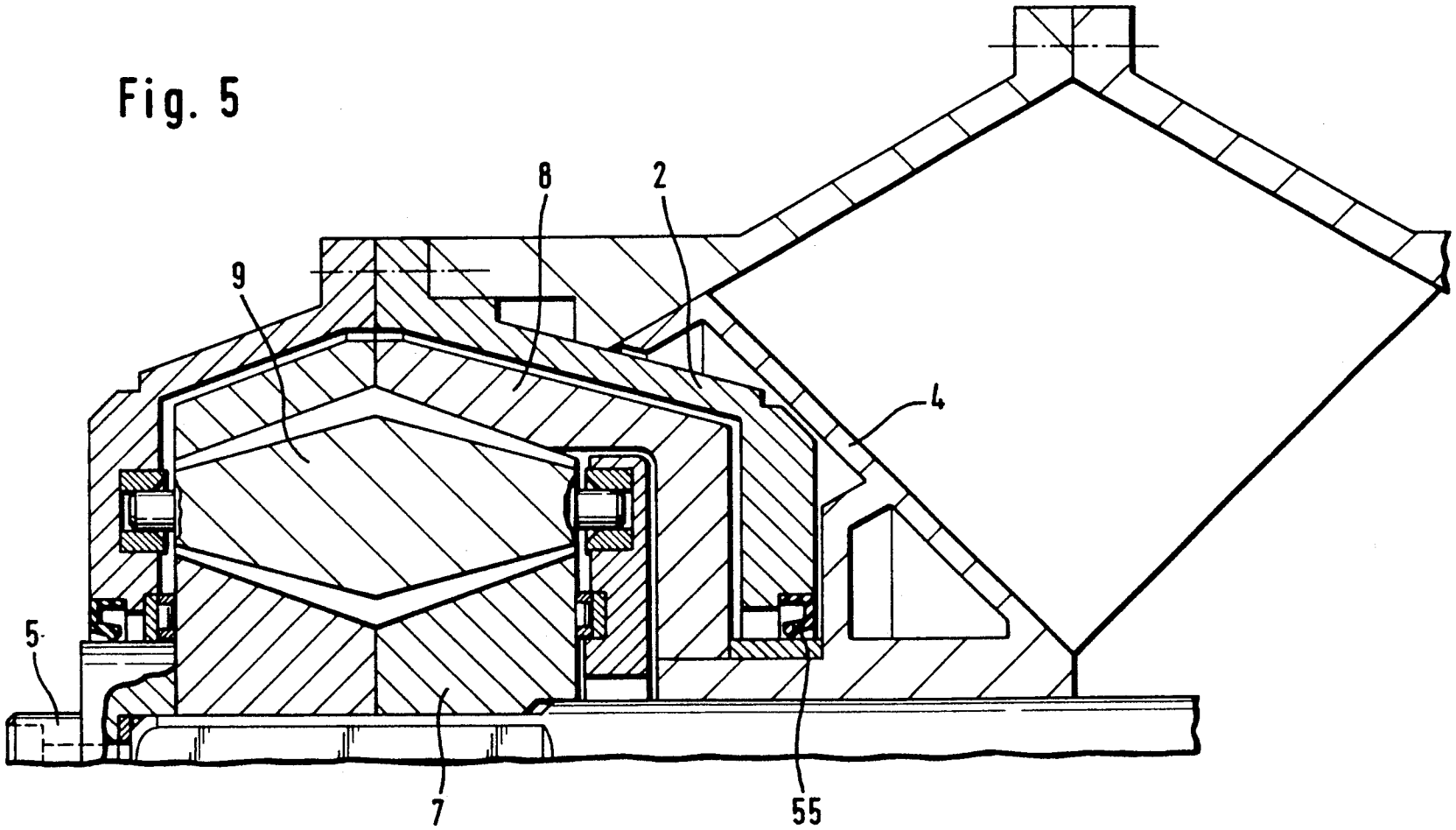
FIG. 5 shows, in section, a somewhat modified embodiment of the rotary piston machine of FIG. 1.

The embodiment of FIG. 5 corresponds essentially to the embodiment of FIG. 3. The only point here is that the outer cam ring 8 is not connected to the rotation body 4 near its periphery but near the shaft 5. The casing 2 therefore only requires a relatively small hole through which the second cam ring 8 and the rotation body 4 are connected at the periphery of the shaft 5. Only relatively slight relative peripheral velocities occur, therefore, in the region of a seal 55 arranged here so that the wear on the seal is less.

Figure 6:
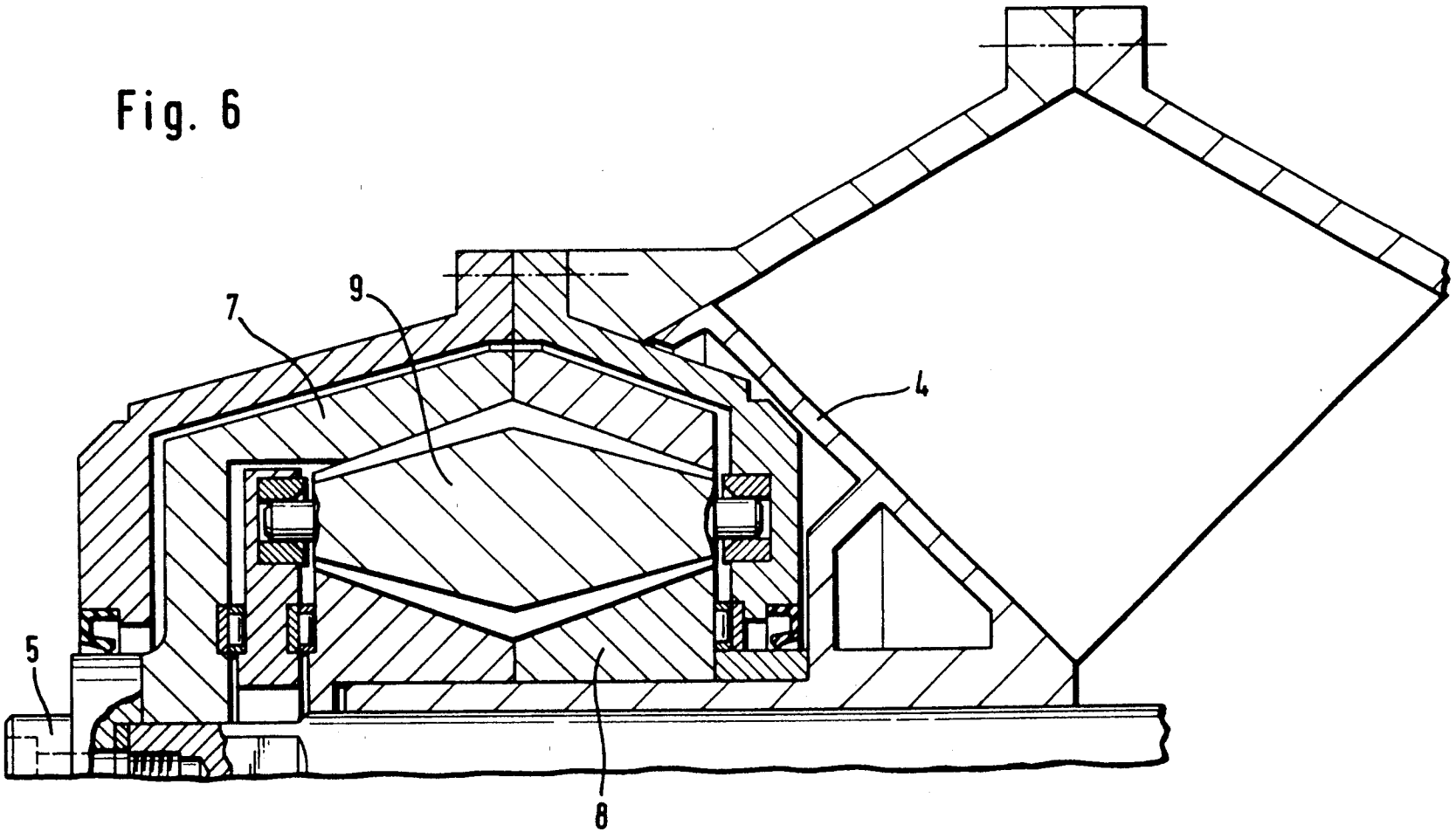
FIG. 6 shows, in cross-section, another embodiment.

In the embodiment of FIG. 6, the first cam ring 7, which is directly connected to the shaft 5, is arranged outside the rolling bodies 9. This provides better engagement between the two parts and permits a better transmission of the torque to the rolling bodies 9. The second cam ring 8 is arranged within the rolling bodies 9 and is again connected to the rotation body 4. The advantage is that the non-uniformly moved mass is smaller than in the case of the first embodiment.

Figure 7:
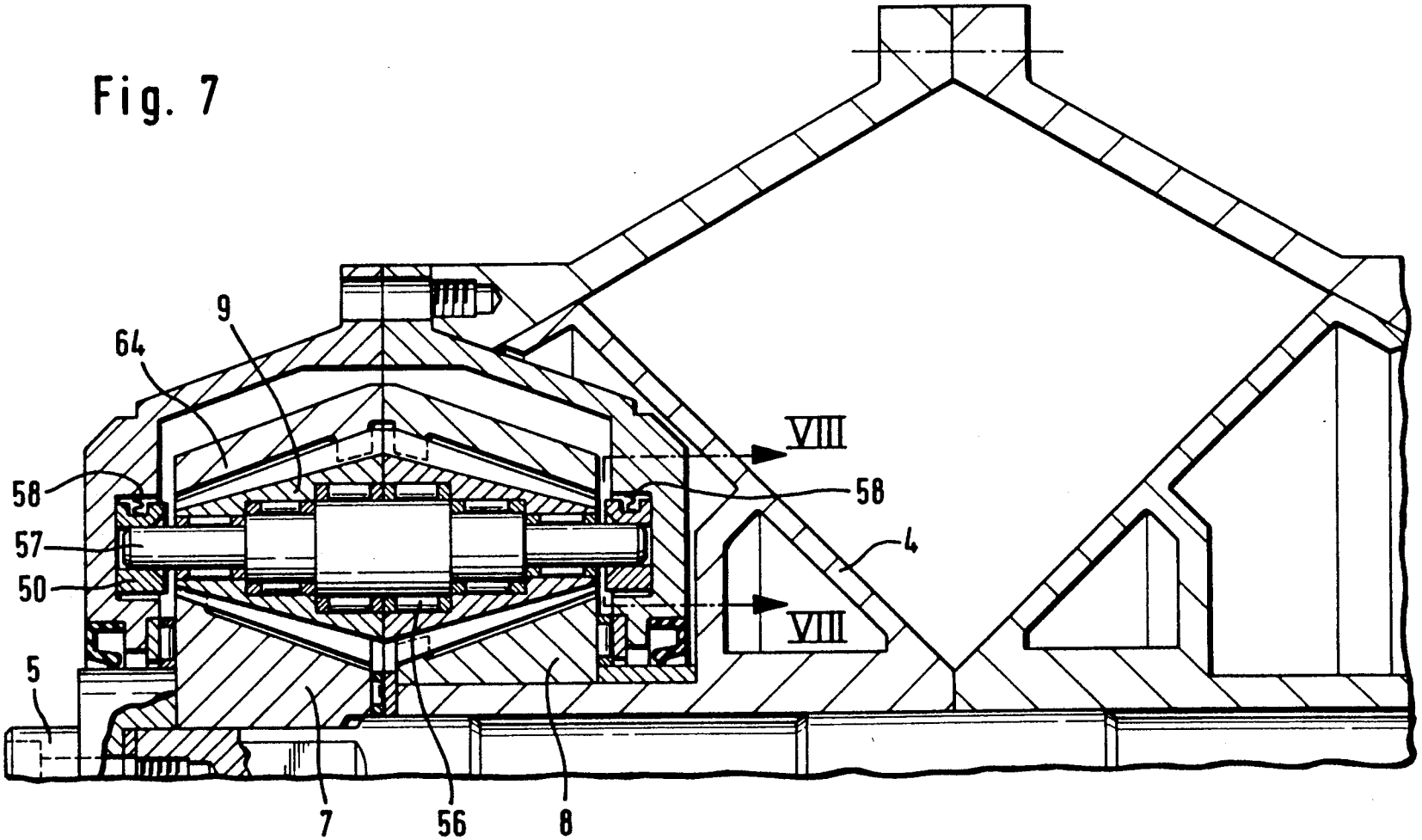
FIG. 7 shows yet another embodiment in section.
Figure 8:
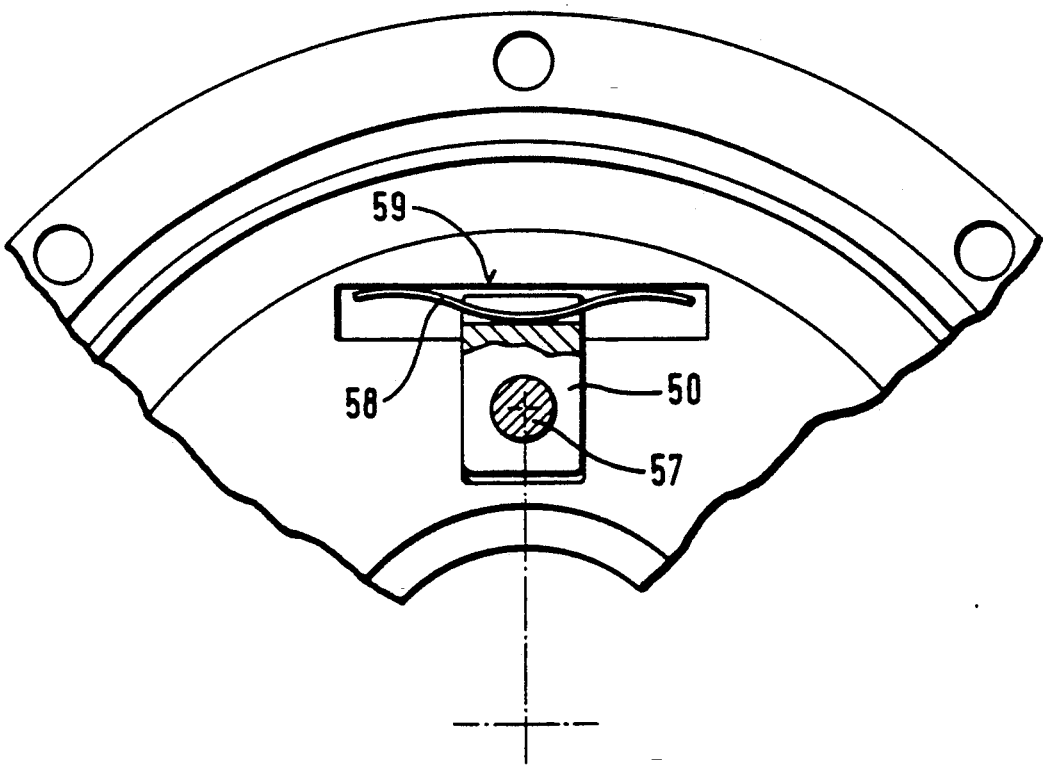
FIG. 8 shows a cross-section along the line VIII—VIII of FIG. 7.

In the embodiment of FIG. 7, the first cam ring 7 is arranged adjacent to the second cam ring 8; both cam rings are arranged within the rolling body 9. The first cam ring 7 is torsionally connected to the shaft 5 and the second cam ring 8 is torsionally connected to the rotation body 4. The torque transmission takes place without an outer cam ring. In this case, however, a cam ring 64 which can be freely rotated, apart from the teeth, is provided. This cam ring 64 is moved and accelerated or decelerated oppositely to the rotation body 4 so that the machine runs more evenly.

It may also be seen in the figure that the rotary body 9 is built up from two parts and is supported by means of a step-shaped bearing 56 on a central shaft 57. The central shaft 57 is supported in cuboid bearings 50 which cannot move in the peripheral direction but can move outwards a little in the radial direction against the force of a spring 58. If no torques are transmitted, the bearings 50 are in the radially inner position and are then pressed outwards in the case of larger torques against the force of the spring or springs 58, limits being set to this outwardly directed motion. The bearings 50, the shaft 57 of the rotation bodies and the spring 58 are represented even more clearly in FIG. 8. The stop surface 59, which limits the radially outward motion of the bearing part 50 may also be recognised in this figure.

Figure 9:
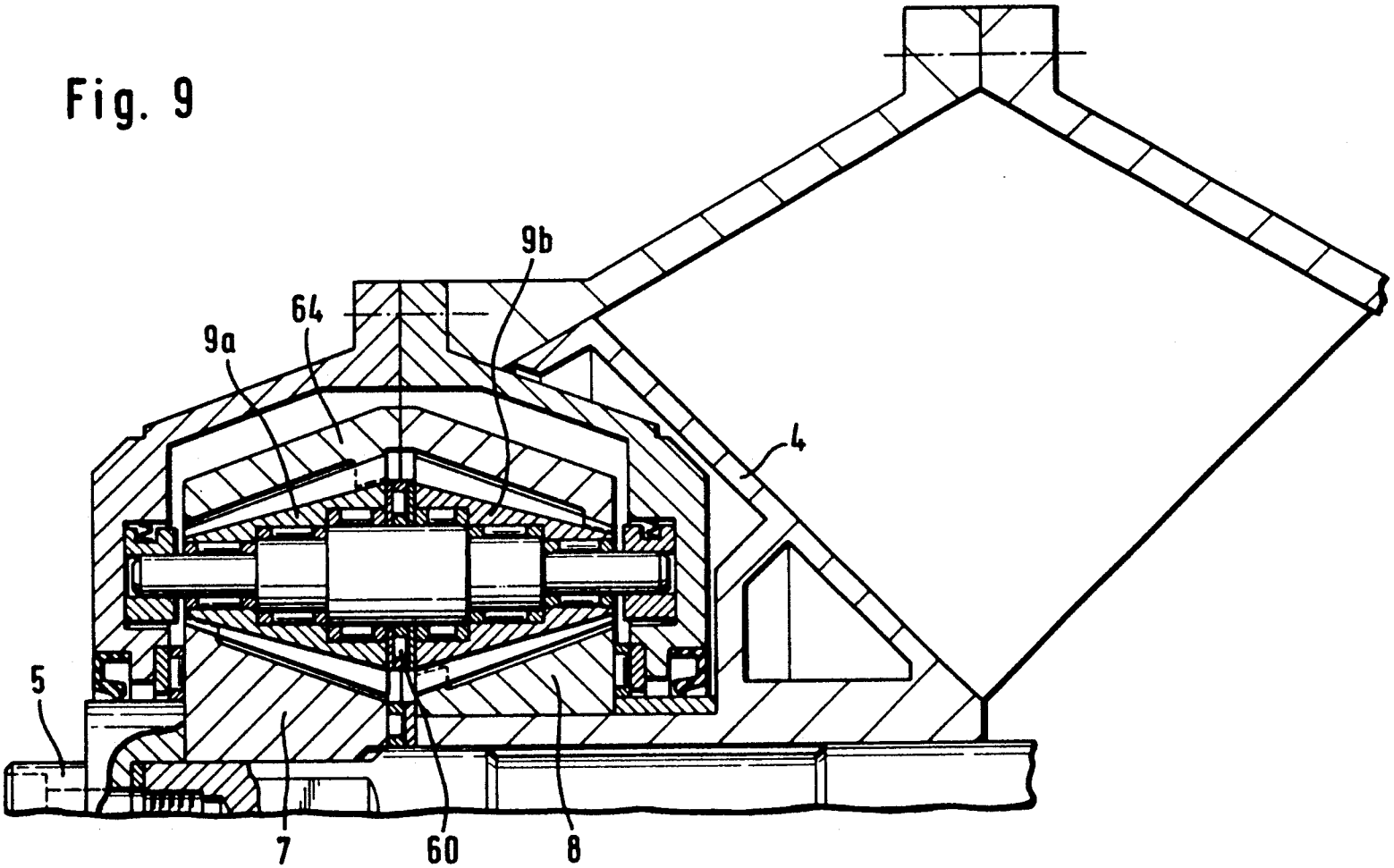
FIG. 9 shows, in cross-section, yet another embodiment.

In the embodiment of FIG. 9, the rolling body consists of two parts 9*a* and 9*b* between which bearings 60 are arranged. The torque is transmitted from the shaft to the first cam ring 7, from there to the left-hand rolling body part 9*a* and from there to the outer cam ring 64 of large mass, which again acts against torque fluctuations and rotational accelerations of the rotation body 4 or compensates for them. The transmission of the torque then takes place from the cam ring 64 of large mass to the right-hand part 9*b* of the rolling body and from there to the inner second cam ring 8, which is again connected to the rotation body 4. There is a double transmission ratio in this case.

Figure 10:
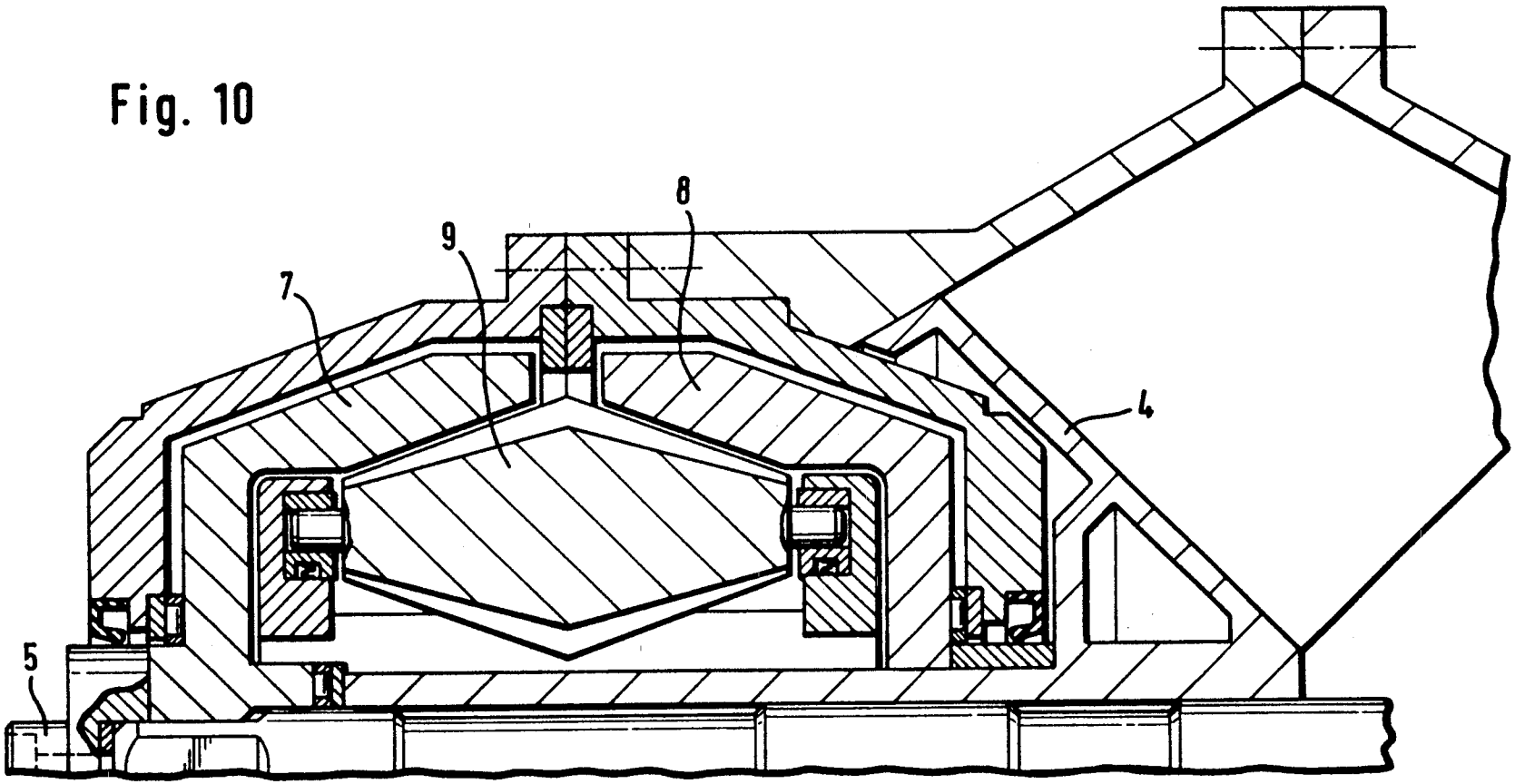
FIG. 10 shows, in cross-section, yet another embodiment.

In the embodiment of FIG. 10, both the first cam ring 7 and the second cam ring 8 engage externally on the rolling body 9. This provides a more reliable torque transmission from the cam rings to the rolling body and vice versa, because the rolling body 9 fits into corresponding curved areas of the cam rings 7 and 8 whereas, in the case of an inner cam ring, the contact which takes place is more or less only point contact. The first cam ring 7 is rotationally connected to the shaft 5 and the second cam ring 8 to the rotation body 4.

Figure 11:
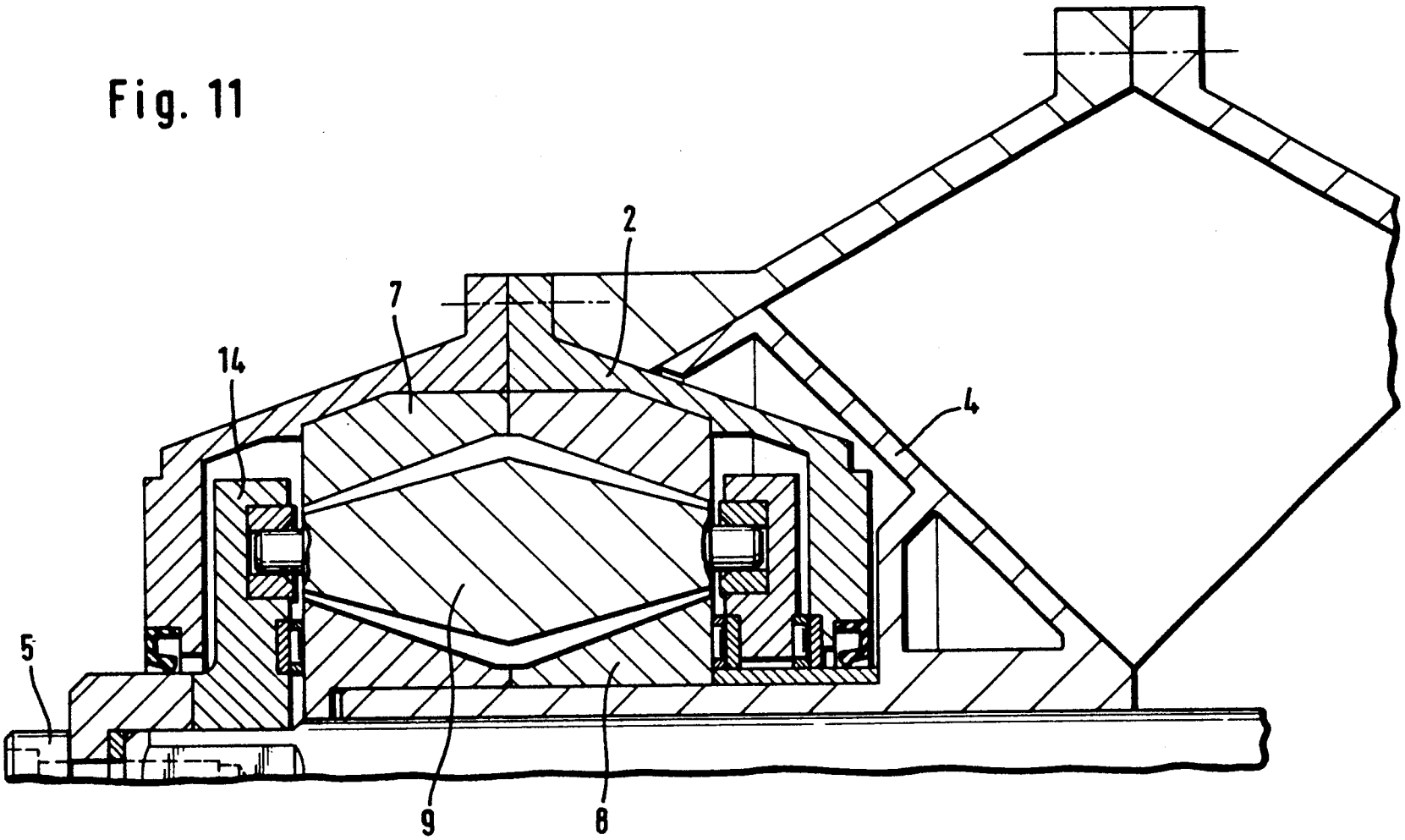
FIG. 11 shows yet another embodiment in cross-section.

In the embodiment of FIG. 11, the first cam ring 7 is connected to the casing 2. The torque from the shaft 5 is transmitted to the cage 14 connected to it, this cage 14 rotating with the shaft 5. The torque is then transmitted via the freely rotating rolling body 9 to the second cam ring 8 which is in turn connected to the rotation body 4.

Figure 12:
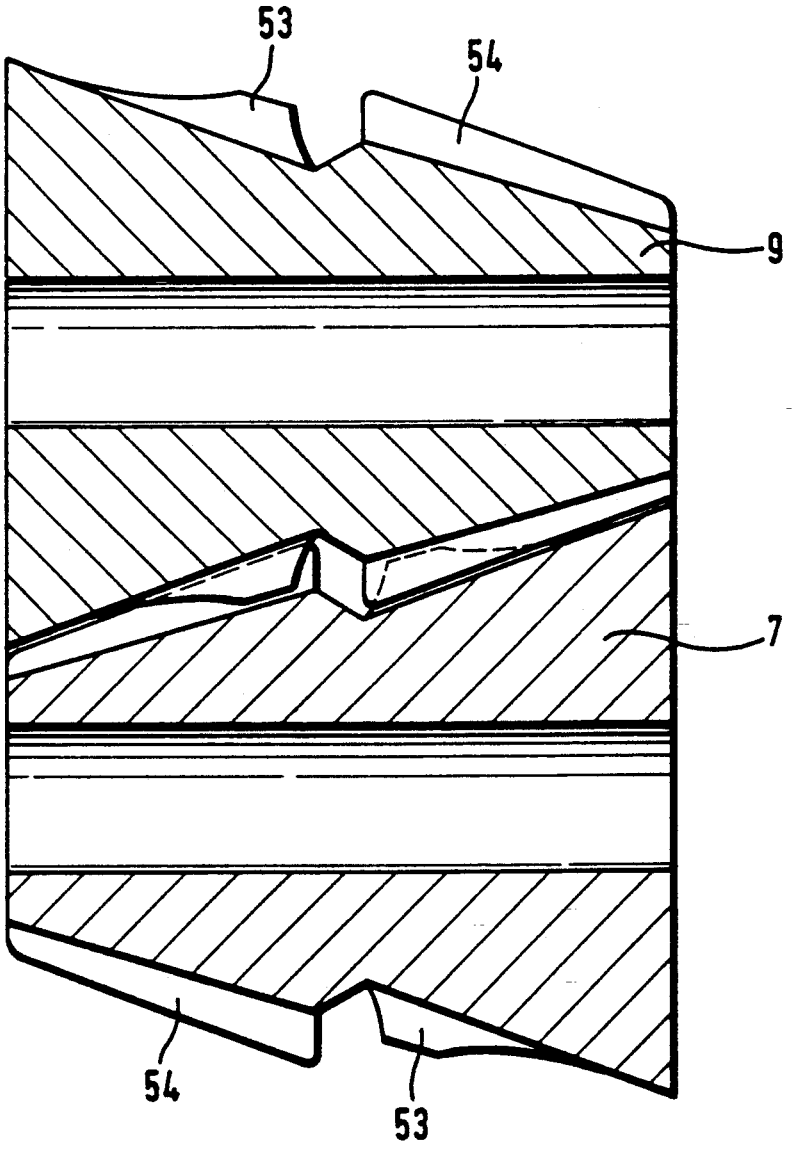
FIG. 12 shows, in axial section, a different type of teeth and cam tracks.
Figure 13:
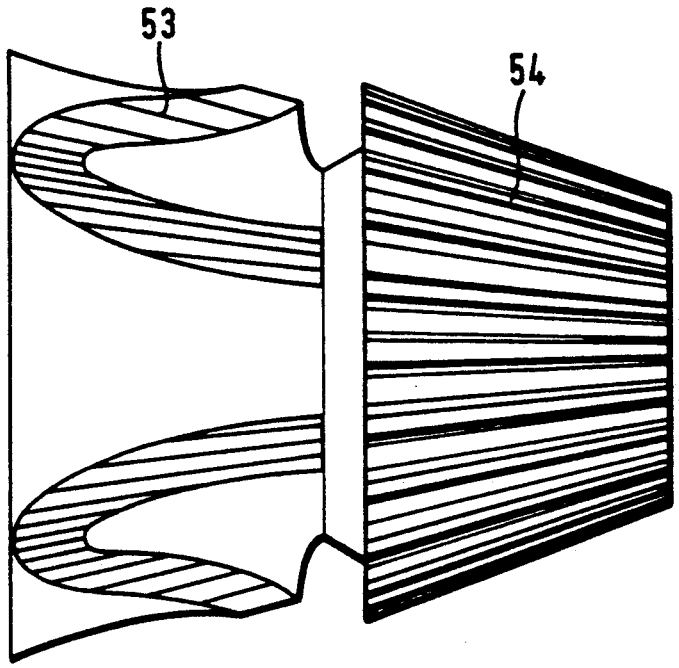
FIG. 13 shows a cam ring with the modified teeth and cam track of FIG. 12.

In the embodiment of FIG. 12 and 13, the inner ring (only one inner ring half is shown), for example the inner ring 7 of the embodiment of FIG. 1 to 4, is provided as shown in FIG. 13, with bevel-wheel teeth 54 in the apex part and with cam track teeth 53 in the part located further towards the end of the truncated cone. This avoids the teeth having very large distances apart at the end of the truncated cone.

The rolling body 9 or the rolling body half 9, which is represented in FIG. 12, is configured in an exactly complementary manner. The interrupted cam tracks 53 are continued in an analogous manner in the respectively other part.

Figure 14:
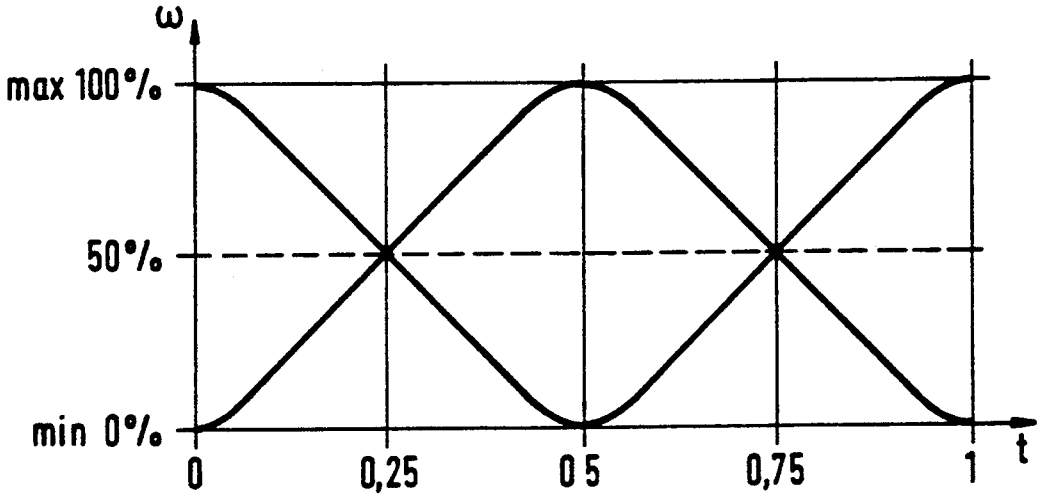
FIG. 14 shows a graphical representation of the change with time of the angular velocity of the cam rings.

It may be seen from the diagram of FIG. 14 that during the course of a cycle (0–1 on the t axis), the angular velocity of the two cam rings 8 in each case moves from a minimum value to a maximum value and then back to a minimum value. After half a period in each case, the minimum value of one cam ring has changed to the maximum value and vice versa. Both reach the half value precisely in the centre between the maximum values in each case. In the region of the maxima and minima, the curves are not peaked but are flattened so that a larger period is available here for gas exchange.

I claim:

1. Rotary piston machine having a casing (2), having a shaft (5) supported in the casing (2), having an annular space (1) in which two rotation bodies (3, 4) are arranged and on whose walls, in which inlet and outlet openings (6*a*–6*h*) are provided for the working medium, the rotation bodies (3, 4) are in sealing contact, each rotation body (3, 4) having sector-shaped paddles (3*a*–3*d*, 4*a*–4*d*) extending radially outwards, the two rotation bodies (3, 4) being coaxially arranged and their paddles interleaving with one another in such a way that each paddle of one rotation body is arranged between two paddles of the other rotation body, a cam track control (7, 8, 9) being provided by means of which, on rotation of the shaft (5), the two rotation bodies (3, 4) execute revolutions with cyclic changes to the rotational velocity and the distances between the paddles of the two rotation bodies, and the cam track control has first cam track control means in the form of first cam rings (7), second cam track control means in the form of second cam rings (8) and third cam track control means in the form of a cage (14) with, held within it so that they cannot be displaced in the peripheral direction, rolling bodies (9) narrowing conically to both ends, which rolling bodies (9) roll on the first (7) and second (8) cam rings, one (7, 8, 14) of the cam track control means being connected to the shaft (5) and another (7, 8, 14) of the cam track control means being torsionally connected to one of the rotation bodies (3, 4) and the remaining cam track control means (7, 8, 14) being connected to the casing (2), characterised in that the rolling bodies (9) are provided with bevel-wheel teeth (51), in that the surfaces, directed towards the rolling bodies (9), of the cam tracks (53) of the cam rings (7, 8) are arranged in a rotationally symmetrical area corresponding to the surface of the rolling bodies (9) and are provided with corresponding bevel-wheel teeth (54), and in that, as a maximum, one cam track control with a first and a second cam ring (7, 8) and rolling bodies (9) is provided for each rotation body (3, 4).

2. Rotary piston machine according to claim 1, characterised in that one cam track control (7, 8, 9, 51, 52) is provided for each rotation body (3, 4).

3. Rotary piston machine according to claim 1, characterised in that the cam rings (7, 8) are substantially rotationally symmetrical with the exception of the cam tracks (53).

4. Rotary piston machine according to claim 1, characterised in that the teeth (51, 54) are involute teeth whose involute geometry is at right angles to the axis of the rolling body (9).

5. Rotary piston machine according to claim 1, characterised in that the cam rings (7, 8) are built up from two axially sequential halves.

6. Rotary piston machine according to claim 5, characterised in that the rolling bodies (9) are held in bearing arrangements (50) which can be displaced in the radial direction.

7. Rotary piston machine according to claim 6, characterised in that the journals of the rolling bodies (9) in the bearing arrangements (50) are subjected to an elastic force in the direction towards the axis of rotation.

8. Rotary piston machine according to claim 7, characterised in that the elastic force is a spring force, a gas pressure or a hydraulic pressure.

9. Rotary piston machine according to claim 1, characterised in that the number of teeth of the inner and outer cam rings (7, 8) is the same and is divisible by the number of paddles (3*a*, 3*b*, 3*c*, 3*d*).

10. Rotary piston machine according to claim 1, characterised in that the number of rolling bodies ( 9 ) of each cam track control ( 7, 8, 9, 51, 52) is divisible by the number of paddles of the rotation body (3, 4).

11. Rotary piston machine according to claim 1, characterised in that the first cam rings (7) are torsionally connected to the shaft (5) and the second cam rings (8) are torsionally connected to a rotation body (3, 4) and the cage (14) is connected to the casing.

12. Rotary piston machine according to claim 11, characterised in that the first cam rings (7) are arranged radially inwardly of the rolling bodies (9) and the second cam rings (8) enclose the first cam rings (7) and the rolling bodies (9).

13. Rotary piston machine according to claim 11, characterised in that the second cam rings (8) are arranged radially inwardly of the rolling bodies (9) and the first cam rings (7) enclose the second cam rings (8) and the rolling bodies (9).

14. Rotary piston machine according to claim 11, characterised in that the first (7) and second (8) cam rings are arranged adjacent to one another radially inwardly of the rolling bodies (9).

15. Rotary piston machine according to claim 14, characterised in that the rolling bodies are enclosed by a third cam ring (64) of large mass.

16. Rotary piston machine according to claim 15, characterised in that the rolling bodies (9) consist of two parts (9*a*, 9*b*) which can be rotated independently of one another.

17. Rotary piston machine according to claim 11, characterised in that the first (7) and second (8) cam rings enclose the rolling bodies (9).

18. Rotary piston machine according to claim 1, characterised in that the first cam rings (7) are connected to the casing, the second cam rings (8) are connected to a rotation body (3, 4) and the cage (14) is connected to the shaft (5).

19. Rotary piston machine according to claim 1 characterised in that half of each of the conical surfaces of the rolling bodies (9) and of the cam rings (7, 8, 64) has bevel-wheel teeth (54) and the other half has elevated cam tracks (53).

20. Rotary piston machine according to claim 1, characterised in that the teeth (54) and the cam tracks (53) are configured in such a way that a maximum angular velocity of one rotation body (3, 4) in each case corresponds to a minimum angular velocity of the other rotation body (4, 3), in that the angular velocity maxima and minima are arranged, in each case, at distances apart of half the cycle duration, have the same values in the centre between two extreme values, and in that the change with time is a flattened function in the region of the maxima.

* * * * *